US010718322B1

(12) United States Patent
Rogish

(10) Patent No.: US 10,718,322 B1
(45) Date of Patent: Jul. 21, 2020

(54) HAND-OPERATED OIL PUMP

(71) Applicant: Jason A. Rogish, Smithfield, PA (US)

(72) Inventor: Jason A. Rogish, Smithfield, PA (US)

( * ) Notice: Subject to any disclaimer, the term of this patent is extended or adjusted under 35 U.S.C. 154(b) by 303 days.

(21) Appl. No.: 15/804,486

(22) Filed: Nov. 6, 2017

(51) Int. Cl.

| | |
|---|---|
| ***F04B 33/00*** | (2006.01) |
| ***F04B 53/16*** | (2006.01) |
| ***F04B 53/10*** | (2006.01) |
| ***F04B 53/14*** | (2006.01) |
| ***F04B 53/12*** | (2006.01) |

(52) U.S. Cl.
CPC ..... *F04B 33/00* (2013.01); *F04B 53/1002* (2013.01); *F04B 53/1037* (2013.01); *F04B 53/126* (2013.01); *F04B 53/14* (2013.01); *F04B 53/16* (2013.01)

(58) Field of Classification Search
CPC ..... F04B 33/00; F04B 33/005; F04B 39/12; F04B 53/123; F04B 53/128
See application file for complete search history.

(56) References Cited

U.S. PATENT DOCUMENTS 1,067,999 A 4/1912 Merritt
2,029,781 A 2/1936 McLean
3,904,326 A * 9/1975 Clement ..... F04B 9/14 417/571
5,002,154 A 3/1991 Chen
5,061,239 A 10/1991 Shiels
5,489,196 A * 2/1996 Lee ..... F04B 9/14 417/239
5,669,532 A * 9/1997 Dorow ..... B05B 9/0816 222/401
5,775,200 A 7/1998 Tsai
5,823,754 A * 10/1998 Lee ..... E03C 1/308 417/437
6,135,733 A * 10/2000 Wu ..... F04B 33/005 417/467
6,371,741 B1 * 4/2002 Wu ..... F04B 19/02 417/446
7,188,377 B2 * 3/2007 Smith ..... E03D 9/00 4/255.02
2003/0071079 A1 * 4/2003 Petrovas ..... F04B 9/14 222/401
2004/0237182 A1 12/2004 Shih
2012/0138387 A1 * 6/2012 Torell ..... F16N 3/08 184/28
2013/0183170 A1 * 7/2013 Laermer ..... F04B 43/02 417/313
2017/0145993 A1 * 5/2017 Liao ..... F04B 39/10

* cited by examiner

*Primary Examiner* — Dominick L Plakkoottam
(74) *Attorney, Agent, or Firm* — Cramer Patent & Design, PLLC; Aaron R. Cramer

(57) ABSTRACT

A manual pumping means is capable of engaging an oil fill port of a vehicle motor so as to pressurize internal portions of the motor and thus propel the motor oil contained within the motor out of a drain portion and into a receiving vessel. The pump would allow extraction of the oil in an expeditious manner, therefore reducing the time required to perform an oil change upon the vehicle.

6 Claims, 3 Drawing Sheets

HAND-OPERATED OIL PUMP

RELATED APPLICATIONS

None.

FIELD OF THE INVENTION

The present invention relates generally to the field of hand-operated oil pumps.

BACKGROUND OF THE INVENTION

When changing oil in a vehicle, there are many things to accomplish either prior to or during the act. The first step is removing the spent oil already in the motor. Unfortunately, this is typically the longest step in that it takes a good deal of time for the spent oil to be removed from the motor, typically due to the small orifice of the drain port, the viscosity of the spent oil, and the inability to add atmospheric pressure in order to facilitate the removal of the spent oil.

As such, there is a need for an instrument or tool that can speed up the process of removing the spent oil and also ensuring that all spent motor oil is eliminated so as to not contaminate fresh motor oil that will be put in. Such an instrument or tool should be easy to install and use, be relatively portable and able to be adaptable to most sizes of engines, and to accomplish the spent oil removal process in a quick and efficient manner. Also, such an instrument or tool should be either utilized manually or be able to be quickly attached to a compressor to speed up the process.

SUMMARY OF THE INVENTION

The inventor has recognized the aforementioned inherent problems and lack in the art and observed that there is a need for a hand-operated oil pump.

It is therefore an object of the invention to provide a pump comprising a pump assembly, a shaft and an adapter. The pump assembly comprises a cylinder defining an interior, a cylinder interior, a cylinder first end, a cylinder second end, a cap having a shaft aperture which is secured to the cylinder first end, a cylinder port which is disposed within the cylinder second end, a first valve which disposed adjacent the cylinder second end and a second valve which is disposed subjacent the cylinder port. The shaft is movably disposed within the shaft aperture and comprises a handle which is secured to a shaft first end and residing outside the cylinder and a piston which is secured to a shaft second end and moveable within the cylinder interior. The adapter comprises an adapter interior, an adapter first end which is secured to the cylinder second end and subjacent the first valve and over the second valve, an adapter second end opposite the adapter first end and an adapter outlet which is disposed within the adapter second end and in environmental communication with the adapter interior. The cylinder interior and the adapter interior are in environmental communication through the second valve. When the handle is actuated in a first direction, the piston is actuated in the first direction thereby generating a first force capable of drawing a gas in fluid communication with the first valve into the cylinder interior. When the handle is actuated in a second direction the piston is actuated in the second direction thereby generating a second force capable of expelling the gas through the second valve. In an alternate embodiment, the handle may be removable.

The cylinder may comprise a down stop which is disposed upon an interior wall of the cylinder adjacent the first valve. The first valve may comprise a first valve port and a flapper which is moveably disposed adjacent the down stop and adjacent the first valve port. When the handle is actuated in the first direction, the flapper is moved away from the first valve port thereby opening the first valve port. When the handle is actuated in the second direction, the flapper is moved against an interior side of the first valve port thereby closing the first valve port.

The second valve may comprise a second valve housing defining a second valve interior in environmental communication with the cylinder port, a second valve first port which is disposed within the second valve housing and is in environmental communication with the second valve interior and the adapter interior, a second valve second port which is disposed within the second valve housing, opposite the second valve first port and in environmental communication with the second valve housing and the adapter interior, a spring which is secured at a spring first end to an interior wall of the second valve housing opposite the cylinder port and a ball which is secured to a spring second end adjacent the cylinder port and capable of mechanical communication with the cylinder port. When the handle is actuated in the first direction, the ball is moved over the cylinder port thereby closing the cylinder port. When the handle is actuated in the second direction, the ball is moved away from the cylinder port thereby opening the cylinder port.

The piston may also comprise a first gasket which is centrally and radially disposed thereabout. The adapter may comprise an adapter upper section at the adapter first end, a second gasket which is radially disposed subjacent the adapter upper section and a nozzle at the adapter second end.

The nozzle may be conical, and thereby configured to permit insertion of the nozzle into an oil fill port of an engine. The adapter may comprise rubber. The cap and the cylinder may be integrally molded while the cylinder may be made of a durable plastic.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
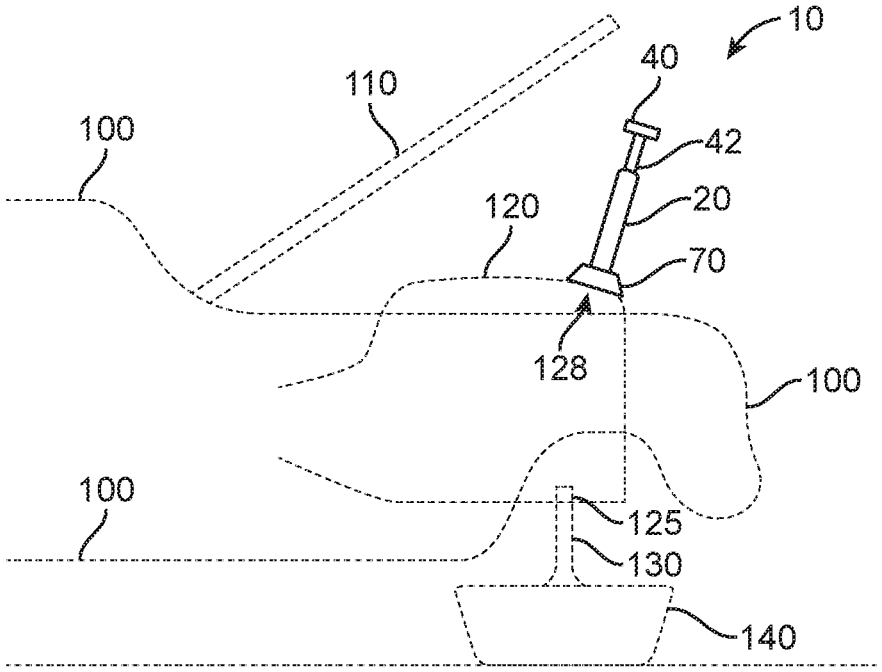
FIG. 1 is an environmental view of a hand-operated oil pump 10 depicting an in-use state, according to a preferred embodiment of the present invention.

10 hand-operated oil pump
20 pump assembly
22 cylinder
24 cap
25 shaft aperture
26 first check valve
27 first check valve inlet port
29 valve seat/port

30 second check valve
31 valve housing
32 ball
33 spring
34 outlet port
40 handle
42 shaft
43 threaded region
44 piston
46 "O"-ring gasket
48 down stop feature
70 adapter
72 nozzle
73 adapter outlet
74 gasket ring
76 adapter upper section
100 vehicle
110 hood
120 motor
125 drain/plug
128 oil fill port
130 oil flow
140 receiving vessel

DETAILED DESCRIPTION OF THE PREFERRED EMBODIMENT

Figure 2:
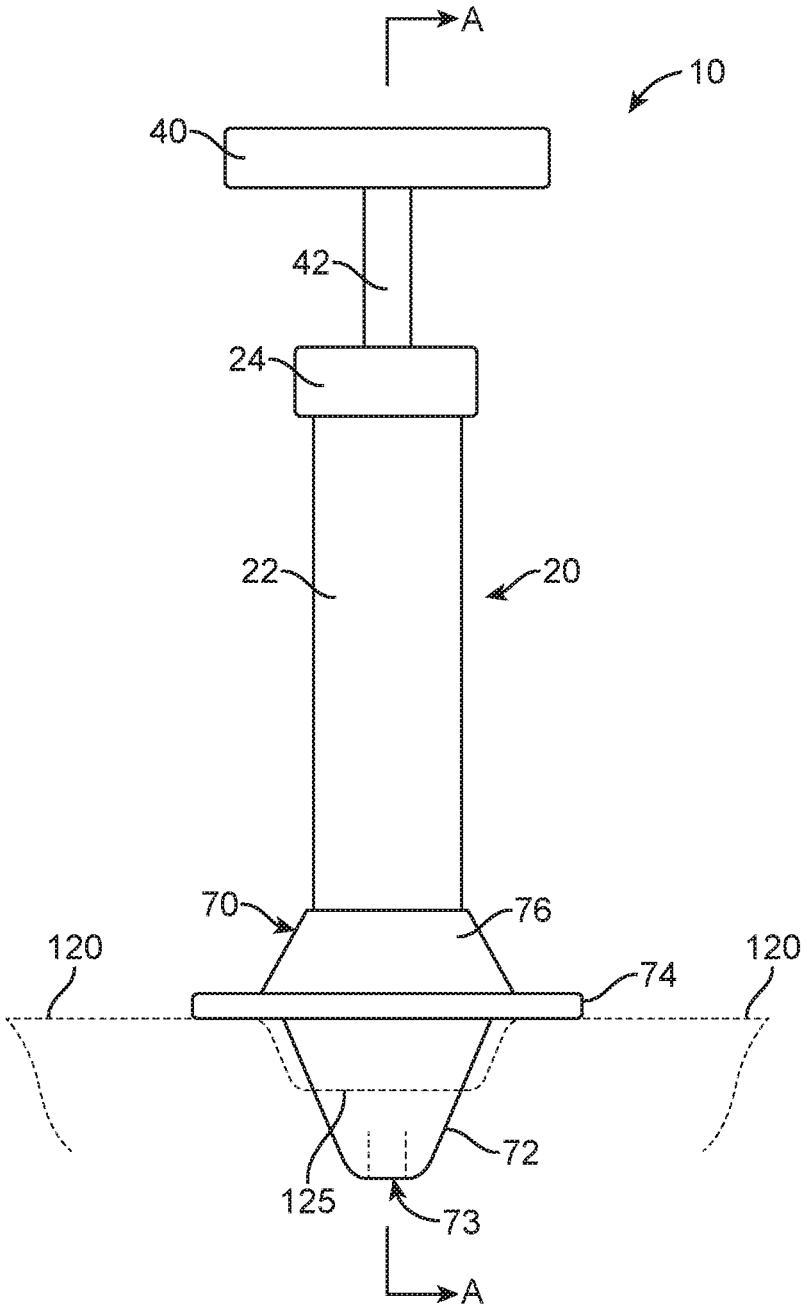
FIG. 2 is a close-up side view of the hand-operated oil pump 10 also depicting an in-use state, according to a preferred embodiment of the present invention; and, FIG. 3 is a sectional view of the hand-operated oil pump 10 taken along section line A-A (see FIG. 2), according to a preferred embodiment of the present invention.
Figure 3:
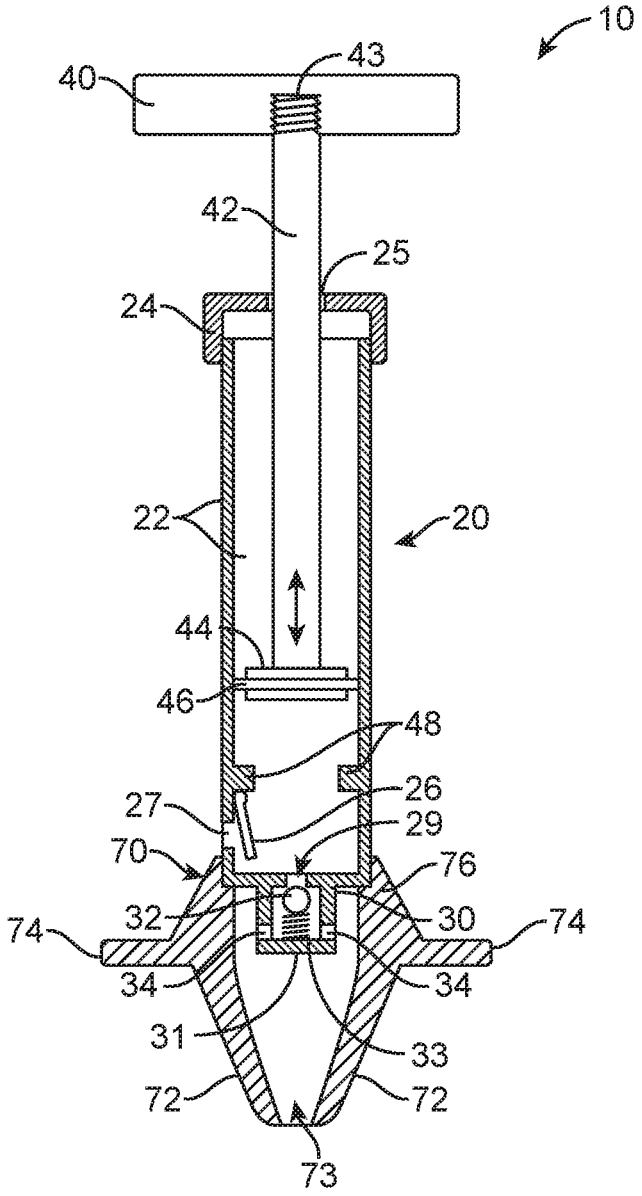

The best mode for carrying out the invention is presented in terms of its preferred embodiment, herein depicted within FIG. 1 through 3. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

The present invention describes a hand operated oil pump (herein described as the "device") 10, which provides a pumping means capable of pressurizing internal portions of a motor 120 within a vehicle 100, so as to propel a volume of motor oil 130 out of a drain/plug portion 125 of the motor 120, thereby saving time and effort while performing an oil change upon the vehicle 100.

Referring now to FIG. 1, an environmental view of the device 10 depicting an in-use state, according to a preferred embodiment of the present invention, is disclosed. The device 10 provides a cylindrical pump assembly 20 which includes a manually reciprocated handle 40. The pump assembly 20 also includes a form compliant rubber adapter 70 affixed to a lower end portion which allows the device 10 to be inserted into an oil fill port portion 128 of the motor 120. The adapter 70 forms a nearly "air-tight" connection with the oil fill port 128 to enable pressurization of the interior of the motor 120 as the pump assembly 20 pumps air into the motor 120.

Referring now to FIGS. 2 and 3, side and sectional views of the device 10, according to a preferred embodiment of the present invention, are disclosed. The pump assembly 20 includes portions which act to produce a one-way flow of pressurized air through the adapter 70 and into the motor 120. The pump assembly 20 includes an elongated hollow cylinder 22 which contains and guides a piston 44 along inner surface portions.

The cylinder 22 also includes an integral or adhesively bonded cap portion 24 along a top edge portion. The cap 24 in turn includes an integral and centrally located shaft aperture 25 which acts to guide a cylindrical shaft portion 42 as it is motioned vertically within the cylinder 22 in a reciprocating manner. A top portion of the shaft 42 provides attachment of the handle 40 while a bottom end portion of the shaft 42 is rigidly affixed to the aforementioned piston 44.

The shaft 42 provides perpendicular attachment to the "T"-shaped handle 40 via a threaded region portion 43 of the shaft 42. The handle 40 is located above the cap 24. The handle 40 enables a user to motion the attached shaft 42 and piston 44 portions within the cylinder 22 so as to displace the air contained within the cylinder 22. The piston 44 is affixed in a perpendicular orientation to the shaft 42 via integral molding, a threaded connection, or the like. The piston 44 slides vertically within the cylinder 22 and includes an annular rubber "O"-ring gasket 46 which forms an air-tight seal against the piston 44 and the inner surfaces of the cylinder 22, thereby pressurizing and propelling the volume of air below the piston 44. The cylinder 22 is shown here including a pair of integrally-molded down-stop feature 48 along an inner surface which act to limit downward motion of the piston 44 to a point above check valve portions 26, 30 of the pump assembly 20.

The pump assembly 20 provides internal features to direct the air within the cylinder 22 through the adapter 70 and into the motor 120 via a first check valve 26 and a second check valve 30. The check valves 26, 30 are located in a bottom portion of the cylinder 22. The first check valve 26 includes a first check valve inlet port 27 formed or drilled through a wall portion of the cylinder 22 which acts to allow air to enter the cylinder 22 below the piston 44 in a one-way fashion as the piston 44 is raised. The second check valve 30 allows the compressed air to exit the cylinder 22 and enter the adapter 70 in a one-way manner as the piston 44 is lowered within the cylinder 22.

The first check valve 26 is shown here in the form of a "flapper" or "swing" type valve device, and the second check valve 30 is shown here in the form of a "ball-and-seat" type valve device having a ball 32 within a valve housing 31 and being pressed upwardly against a valve seat/port 29 by a spring 33. The valve housing portion 31 of the second check valve 30 further includes at least one (1) outlet port 34 to allow the compressed air to enter an adapter outlet portion 73 of the nozzle 72. However, it is understood that in addition to the illustrated check valve types 26, 30 illustrated here, various other methods of directional air flow control may be utilized with equal effect, and as such should not be interpreted as a limiting factor of the device 10.

The device 10 is preferably made using plastic and rubber materials; however, the major portions of the pump assembly 20 may also be made using metal materials such as aluminum, steel, or the like with equal benefit.

The adapter 70 provides a flexible molded rubber structure including a nozzle 72, having an adapter outlet 73, a gasket ring 74 and an adapter upper portion 76. The adapter 70 is to be permanently affixed to lower edge portions of the cylinder 22 to form an air-tight circular connection, preferably using adhesives or an equivalent joining method. The nozzle 72 forms a tapering cylindrical appendage being sized so as to be inserted partially or completely into an oil fill port portion 128 of an existing vehicle motor 120. The gasket ring 74 provides a circular planar appendage which extends horizontally all around side surfaces of the adapter 70. The gasket ring 74 provides additional sealing of the adapter 70 to surfaces adjacent to the oil fill port 128 as seen in FIG. 2.

It is envisioned that the compliancy of the rubber adapter 70 and the tapered shape of the nozzle 72, along with the gasket ring 74, would provide effective sealing when engaged with the variously sized and shaped oil fill ports 128 of popular vehicles 100, thereby enabling leakage-free entry of the compressed air into the motor 120 to expedite efficient pressurized draining of the oil 130 from the vehicle 100 (see FIG. 1).

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 1.

The method of utilizing the device 10 may be achieved by performing the following steps: procuring the device 10; turning off the motor 120 of the vehicle 100; opening a hood portion 110 of the vehicle 100; removing a cap portion of the oil fill port 128; using a user's hand to grasp the cylinder portion 22 of the device 10; inserting the nozzle portion 72 of the device 10 into the oil fill port 128; sealing the adapter 70 to the motor 120 by continuing to insert the nozzle 72 until either side surfaces of the oil fill port 128 seal against the side portions of the nozzle 72, or until the gasket ring portion 74 of the adapter 70 contacts a top of the oil fill port 128; positioning an oil receiving vessel 140 directly below the drain/plug portion 125 of the motor 120; removing the drain/plug 125; grasping the cylinder portion 22 of the device 10 with one hand, and grasping the handle 40 in a remaining hand; motioning the handle 40 up and down in a reciprocating manner with respect to the cylinder 22; allowing the device 10 to produce compressed air which in turn propels the oil 130 from the motor 120 out of the drain/plug 125 and into the receiving vessel 140; continuing the reciprocating motion of the handle 40 until the oil 130 is completely evacuated from the drain/plug 125 and into the receiving vessel 140; and, benefiting from the reduced time and effort to drain oil 130 from a vehicle 100, afforded a user of the present invention 10.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A hand-operated oil pump, comprising: a pump assembly, comprising: a cylinder, comprising: a cylinder interior; a cylinder first end; a cylinder second end; a cap having a shaft aperture secured to said cylinder first end; a cylinder port disposed within said cylinder second end; a first check valve disposed adjacent said cylinder second end; a second check valve disposed subjacent said cylinder port; a shaft movably disposed within said shaft aperture, comprising: a handle secured to a shaft first end and residing outside said cylinder; and a piston secured to a shaft second end and moveable within said cylinder interior; an adapter, comprising: an adapter interior; an adapter first end secured to said cylinder second end subjacent said first check valve and over said second check valve; an adapter second end opposite said adapter first end; and an adapter outlet disposed within said adapter second end and in environmental communication with said adapter interior; a down stop disposed upon an interior wall of said cylinder adjacent said first check valve, wherein said first check valve comprises a first check valve port and a flapper moveably disposed adjacent said down stop and adjacent said first valve port, wherein when said handle is actuated in a first direction, said flapper is moved away from said first check valve port thereby opening said first check valve port and wherein when said handle is actuated in a second direction, said flapper is moved against an interior side of said first check valve port thereby closing said first check valve port; and a spring secured at a spring first end to an interior wall of said second check valve housing opposite said cylinder port; a ball secured to a spring second end adjacent said cylinder port and capable of mechanical communication with said cylinder port; wherein when said handle is actuated in said first direction, said ball is moved over said cylinder port thereby closing said cylinder port; wherein when said handle is actuated in said second direction, said ball is moved away from said cylinder port thereby opening said cylinder port; wherein said cylinder interior and said adapter interior are in environmental communication through said second check valve; wherein when said handle is actuated in said first direction, said piston is actuated in said first direction thereby generating a first force capable of drawing a gas in fluid communication with said first check valve into said cylinder interior; wherein when said handle is actuated in said second direction, said ball is moved away from said cylinder port thereby opening said cylinder port; wherein said adapter comprises an adapter upper section at said adapter first end, a second gasket radially disposed subjacent said adapter upper section, and a nozzle at said adapter second end; wherein said second check valve comprises a second check valve housing defining a second check valve interior in environmental communication with said cylinder port, a second check valve first port disposed within said second check valve housing and in environmental communication with said second check valve interior and said adapter interior, a second check valve second port disposed within said second check valve housing, opposite said second check valve first port and in environmental communication with said second check valve housing and said adapter interior; wherein said cap and said cylinder are integrally molded; and wherein said cap and said cylinder are integrally molded.

2. The hand-operated oil pump of claim 1, wherein said nozzle is conical to permit insertion of said nozzle into an oil fill port of an engine.

3. The hand-operated oil pump of claim 1, wherein said adapter comprises rubber.

4. A hand-operated oil pump, comprising:

a pump assembly, comprising:

a cylinder, comprising:

a cylinder interior;

a cylinder first end;

a cylinder second end;

a cap having a shaft aperture secured to said cylinder first end;

a cylinder port disposed within said cylinder second end;

a first check valve disposed adjacent said cylinder second end;

a second check valve disposed subjacent said cylinder port;

a shaft movably disposed within said shaft aperture comprising:

a handle removably secured to a shaft first end and residing outside said cylinder; and a piston secured to a shaft second end and moveable within said cylinder interior;

an adapter, comprising:

an adapter interior;

an adapter first end secured to said cylinder second end subjacent said first check valve and over said second check valve;

an adapter second end opposite said adapter first end;

an adapter outlet disposed within said adapter second end and in environmental communication with said adapter interior;

a down stop disposed upon an interior wall of said cylinder adjacent said first check valve;

wherein said cylinder interior and said adapter interior are in environmental communication through said second check valve;

wherein when said handle is actuated in a first direction, said piston is actuated in said first direction thereby generating a first force capable of drawing a gas in fluid communication with said first check valve into said cylinder interior;

wherein when said handle is actuated in a second direction said piston is actuated in said second direction thereby generating a second force capable of expelling said gas through said second check valve;

wherein said first check valve comprises a first check valve port and a flapper moveably disposed adjacent said down stop and adjacent said first check valve port;

wherein when said handle is actuated in said first direction, said flapper is moved away from said first check valve port thereby opening said first check valve port; and wherein when said handle is actuated in said second direction, said flapper is moved against an interior side of said first check valve port thereby closing said first check valve port;

wherein said second check valve comprises a second check valve housing defining a second check valve interior in environmental communication with said cylinder port;

a second check valve first port disposed within said second check valve housing and in environmental communication with said second check valve interior and said adapter interior;

a second check valve second port disposed within said second check valve housing, opposite said second check valve first port and in environmental communication with said second check valve housing and said adapter interior;

a spring secured at a spring first end to an interior wall of said second check valve housing opposite said cylinder port; and a ball secured to a spring second end adjacent said cylinder port and capable of mechanical communication with said cylinder port;

wherein when said handle is actuated in said first direction, said ball is moved over said cylinder port thereby closing said cylinder port;

wherein when said handle is actuated in said second direction, said ball is moved away from said cylinder port thereby opening said cylinder port;

wherein said piston further comprises a first gasket centrally and radially disposed thereabout;

wherein said cap and said cylinder are integrally molded; and wherein said cap and said cylinder are integrally molded.

5. The hand-operated oil pump of claim 4, wherein said nozzle is conical to permit insertion of said nozzle into an oil fill port of an engine.

6. The hand-operated oil pump of claim 4, wherein said adapter comprises rubber.

* * * * *